US007573207B2

(12) United States Patent
Zhang et al.

(10) Patent No.: US 7,573,207 B2
(45) Date of Patent: Aug. 11, 2009

(54) DRIVER SYSTEM AND METHOD WITH MULTI-FUNCTION PROTECTION FOR COLD-CATHODE FLUORESCENT LAMP AND EXTERNAL-ELECTRODE FLUORESCENT LAMP

(75) Inventors: Changshan Zhang, Shanghai (CN); Jun Ye, Shanghai (CN); Lieyi Fang, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 11/871,123

(22) Filed: Oct. 11, 2007

(65) Prior Publication Data

US 2008/0088256 A1 Apr. 17, 2008

Related U.S. Application Data

(63) Continuation of application No. 11/245,947, filed on Oct. 6, 2005, now Pat. No. 7,298,097.

(30) Foreign Application Priority Data

Sep. 13, 2005 (CN) ..... 2005 1 0102863

(51) Int. Cl.
*G05F 1/00* (2006.01)

(52) U.S. Cl. ..... 315/291; 315/274; 315/224; 315/247; 315/209 R

(58) Field of Classification Search ..... 315/291, 315/307, 297, 308, 312, 323, 324, 274, 276, 315/279, 224, 225, 247, 246
See application file for complete search history.

(56) References Cited

U.S. PATENT DOCUMENTS 7,298,097 B2 * 11/2007 Zhang et al. ..... 315/291

* cited by examiner

*Primary Examiner*—Tuyet Vo
(74) *Attorney, Agent, or Firm*—Jones Day

(57) ABSTRACT

System and method for driving a cold-cathode fluorescent lamp. The system includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. If the DC input voltage is lower than a predetermined threshold, the system for driving the cold-cathode fluorescent lamp is turned off in response to the one or more control signals.

24 Claims, 7 Drawing Sheets

DRIVER SYSTEM AND METHOD WITH MULTI-FUNCTION PROTECTION FOR COLD-CATHODE FLUORESCENT LAMP AND EXTERNAL-ELECTRODE FLUORESCENT LAMP

CROSS-REFERENCES TO RELATED APPLICATIONS

This application is a continuation of U.S. application Ser. No. 11/245,947, filed Oct. 6, 2005, which claims priority to Chinese Patent Application No. 200510102863.0, filed Sep. 13, 2005. These applications are commonly assigned and incorporated by reference herein for all purposes.

STATEMENT AS TO RIGHTS TO INVENTIONS MADE UNDER FEDERALLY SPONSORED RESEARCH OR DEVELOPMENT

Not applicable

REFERENCE TO A "SEQUENCE LISTING," A TABLE, OR A COMPUTER PROGRAM LISTING APPENDIX SUBMITTED ON A COMPACT DISK

Not applicable

BACKGROUND OF THE INVENTION

The present invention is directed to integrated circuits. More particularly, the invention provides a system and method with multi-function protection. Merely by way of example, the invention has been applied to driving one or more cold-cathode fluorescent lamps, and/or one or more external-electrode fluorescent lamps. But it would be recognized that the invention has a much broader range of applicability.

The cold-cathode fluorescent lamp (CCFL) and external-electrode fluorescent lamp (EEFL) have been widely used to provide backlight for a liquid crystal display (LCD) module. The CCFL and EEFL often each require a high alternate current (AC) voltage such as 2 kV for ignition and normal operation. Such a high AC voltage can be provided by a CCFL driver system or an EEFL driver system. The CCFL driver system and the EEFL driver system each receive a low direct current (DC) voltage and convert the low DC voltage to the high AC voltage.

FIG. 1 is a simplified conventional driver system for CCFL and/or EEFL. The driver system 100 includes a control subsystem 110 and an AC power supply subsystem 120. The control subsystem 110 receives a power supply voltage $V_{DDA}$ and certain control signals. The control signals include an enabling (ENA) signal and a dimming (DIM) signal. In response, the control subsystem 110 outputs gate drive signals to the AC power supply subsystem 120. The AC power supply subsystem 120 includes MOSFET transistors and power transformers, and receives a low DC voltage $V_{IN}$. The MOSFET transistors convert the low DC voltage $V_{IN}$ to a low AC voltage in response to the gate drive signals. The low AC voltage is boosted to a high AC voltage $V_{OUT}$ by the power transformers, and the high AC voltage $V_{OUT}$ is sent to drive a system 190. The system 190 includes CCFLs and/or EEFLs. The system 190 provides a current and voltage feedback to the control subsystem 110.

As discussed above, the power transformers can boost the AC voltage. The increase in AC voltage is often accomplished by a high turn ratio between the secondary winding and the primary winding. The secondary winding usually is formed by a wire having a small diameter such as 0.05 mm. The wire can easily be damaged by bending in the manufacturing process. For example, a breakpoint may exist at the winding terminal that is connected to pins in the transformer bobbin. If the gap at the breakpoint is small, the high AC voltage can jump through the gap by arcing and still drive the system 190 including CCFLs and/or EEFLs. But the arcing process can produce a large amount of heat and even a visible fire. Under these conditions, the driver system 100 should be turned off to prevent any accidents.

FIG. 2 is a simplified conventional system for detecting breakpoint in transformer secondary winding. The secondary winding of a transformer TI includes pins 5 and 6. The pin 6 is biased to the low DC voltage $V_{IN}$ that is different from the ground voltage. Additionally, the DC voltage at the pin 5 is received by a high impedance voltage divider. As shown in FIG. 2, the voltage divider includes resistors R1 and R2 and outputs a voltage $V_{DIV}$ to a transistor $Q_1$. If no breakpoint exists in the secondary winding, the voltage $V_{DIV}$ would be equal to a fraction of $V_{IN}$. As a result, the transistor $Q_1$ is turned on, and the control subsystem 110 is enabled. If a breakpoint exists in the secondary winding, the voltage $V_{DIV}$ would be equal to zero. As a result, the transistor $Q_1$ is turned off, and the control subsystem 110 is disabled. The driver system 100 for CCFL and/or EEFL is thus protected. But the system as shown in FIG. 2 often cannot effectively detect breakpoints for multiple transformers.

Hence it is highly desirable to improve protection techniques for CCFL driver system and EEFL driver system.

BRIEF SUMMARY OF THE INVENTION

The present invention is directed to integrated circuits. More particularly, the invention provides a system and method with multi-function protection. Merely by way of example, the invention has been applied to driving one or more cold-cathode fluorescent lamps, and/or one or more external-electrode fluorescent lamps. But it would be recognized that the invention has a much broader range of applicability.

According to one embodiment of the present invention, a system for driving a cold-cathode fluorescent lamp is provided. The system includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. If the DC input voltage is lower than a predetermined threshold, the system for driving the cold-cathode fluorescent lamp is turned off in response to the one or more control signals.

According to another embodiment, a system for driving a cold-cathode fluorescent lamp includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. If the DC input voltage is higher than a predetermined threshold, the system for driving the cold-cathode fluorescent lamp is turned off in response to the one or more control signals.

According to yet another embodiment, a system for driving a cold-cathode fluorescent lamp includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. The power supply subsystem includes a transformer including a primary winding and a secondary winding. If the DC input voltage is lower than a first predetermined threshold, the system for driving the cold-cathode fluorescent lamp is turned off in response to the one or more control signals. If the DC input voltage is higher than a second predetermined threshold, the system for driving the cold-cathode fluorescent lamp is turned off in response to the one or more control signals. If the secondary winding includes a breakpoint, the system for driving the cold-cathode fluorescent lamp is turned off in response to the one or more control signals.

According to yet another embodiment, a system for driving a cold-cathode fluorescent lamp includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. The power supply subsystem includes a first resistor, a second resistor, a first capacitor, and a transformer including a primary winding and a secondary winding. The secondary winding, the first resistor, and the second resistor are in series. The second resistor is located between the first resistor and the secondary winding, and the secondary winding includes a first terminal biased to a ground voltage level. The first resistor includes a second terminal and a third terminal. The second terminal is biased to the DC input voltage, and the third terminal is coupled to the second resistor. The first resistor and the first capacitor are in parallel between the second terminal and the third terminal, and the third terminal is associated with a first detected voltage. The first detected voltage is compared to a first predetermined voltage for determining the one or more control signals.

According to yet another embodiment, a method for driving a cold-cathode fluorescent lamp includes receiving a DC input voltage, determining whether the DC input voltage is lower than a first predetermined threshold or higher than a second predetermined threshold, and generating one or more control signals based on at least information associated with the DC input voltage, the first predetermined threshold, and the second predetermined threshold. Additionally, the method includes receiving the one or more control signals, converting the DC input voltage into an AC output voltage in response to the one or more control signals, and sending the AC output voltage to a cold-cathode fluorescent lamp. If the DC input voltage is lower than the first predetermined threshold, the AC output voltage is substantially equal to zero. If the DC input voltage is higher than the second predetermined threshold, the AC output voltage is substantially equal to zero.

According to yet another embodiment, a system for driving an external-electrode fluorescent lamp includes a control subsystem configured to generate one or more control signals, and a power supply subsystem configured to receive the one or more control signals and a DC input voltage, convert the DC input voltage to an AC output voltage, and send the AC output voltage to an external-electrode fluorescent lamp. If the DC input voltage is lower than a predetermined threshold, the system for driving the external-electrode fluorescent lamp is turned off in response to the one or more control signals.

According to yet another embodiment, a system for driving an external-electrode fluorescent lamp includes a control subsystem configured to generate one or more control signals, and a power supply subsystem configured to receive the one or more control signals and a DC input voltage, convert the DC input voltage to an AC output voltage, and send the AC output voltage to an external-electrode fluorescent lamp. If the DC input voltage is higher than a predetermined threshold, the system for driving the external-electrode fluorescent lamp is turned off in response to the one or more control signals.

According to yet another embodiment, a system for driving an external-electrode fluorescent lamp includes a control subsystem configured to generate one or more control signals, and a power supply subsystem configured to receive the one or more control signals and a DC input voltage, convert the DC input voltage to an AC output voltage, and send the AC output voltage to an external-electrode fluorescent lamp. The power supply subsystem includes a transformer including a primary winding and a secondary winding. If the DC input voltage is lower than a first predetermined threshold, the system for driving the external-electrode fluorescent lamp is turned off in response to the one or more control signals. If the DC input voltage is higher than a second predetermined threshold, the system for driving the external-electrode fluorescent lamp is turned off in response to the one or more control signals. If the secondary winding includes a breakpoint, the system for driving the external-electrode fluorescent lamp is turned off in response to the one or more control signals.

According to yet another embodiment, a system for driving an external-electrode fluorescent lamp includes a control subsystem configured to generate one or more control signals, and a power supply subsystem configured to receive the one or more control signals and a DC input voltage, convert the DC input voltage to an AC output voltage, and send the AC output voltage to an external-electrode fluorescent lamp. The power supply subsystem includes a first resistor, a second resistor, a first capacitor, and a transformer including a primary winding and a secondary winding. The secondary winding, the first resistor, and the second resistor are in series. The second resistor is located between the first resistor and the secondary winding, and the secondary winding includes a first terminal biased to a ground voltage level. The first resistor includes a second terminal and a third terminal. The second terminal is biased to the DC input voltage, and the third terminal is coupled to the second resistor. The first resistor and the first capacitor are in parallel between the second terminal and the third terminal. The third terminal is associated with a first detected voltage, and the first detected voltage is compared to a first predetermined voltage for determining the one or more control signals.

According to yet another embodiment, a method for driving an external-electrode fluorescent lamp includes receiving a DC input voltage, determining whether the DC input voltage is lower than a first predetermined threshold or higher than a second predetermined threshold, and generating one or more control signals based on at least information associated with the DC input voltage, the first predetermined threshold, and the second predetermined threshold. Additionally, the method includes receiving the one or more control signals, converting the DC input voltage into an AC output voltage in response to the one or more control signals, and sending the AC output voltage to an external-electrode fluorescent lamp. If the DC input voltage is lower than the first predetermined threshold, the AC output voltage is substantially equal to zero. If the DC input voltage is higher than the second predetermined threshold, the AC output voltage is substantially equal to zero.

Many benefits are achieved by way of the present invention over conventional techniques. For example, some embodiments of the present invention provide a driver system with one or more protection mechanisms. For example, the driver system is protected against under-voltage system power supply, over-voltage system power supply, and/or breaking of transformer secondary winding. In another example, the driver system is used to drive one or more cold-cathode fluorescent lamps and/or one or more external-electrode fluorescent lamp. Certain embodiments of the present invention provide protection against breaking of a secondary winding. The breaking of the secondary winding can cause arcing, which may damage the secondary winding. Arcing often is difficult to detect during the testing process, so it is very important to protect the driver system when the breaking of the secondary winding occurs. Some embodiments of the present invention provide protection against under-voltage system power supply. Such protection is very important because a low DC input voltage can cause current stress to a power MOSFET transistor. Certain embodiments of the present invention provide protection against over-voltage system power supply. Such protection is very important because a high DC input voltage can cause voltage stress between the drain and source of a power MOSFET transistor. Depending upon the embodiment, one or more of these benefits may be achieved. These and other benefits will be described in more detail throughout the present specification and more particularly below.

Various additional objects, features and advantages of the present invention can be more fully appreciated with reference to the detailed description and the accompanying drawings that follow.

DETAILED DESCRIPTION OF THE INVENTION

The present invention is directed to integrated circuits. More particularly, the invention provides a system and method with multi-function protection. Merely by way of example, the invention has been applied to driving one or more cold-cathode fluorescent lamps, and/or one or more external-electrode fluorescent lamps. But it would be recognized that the invention has a much broader range of applicability.

Figure 1:
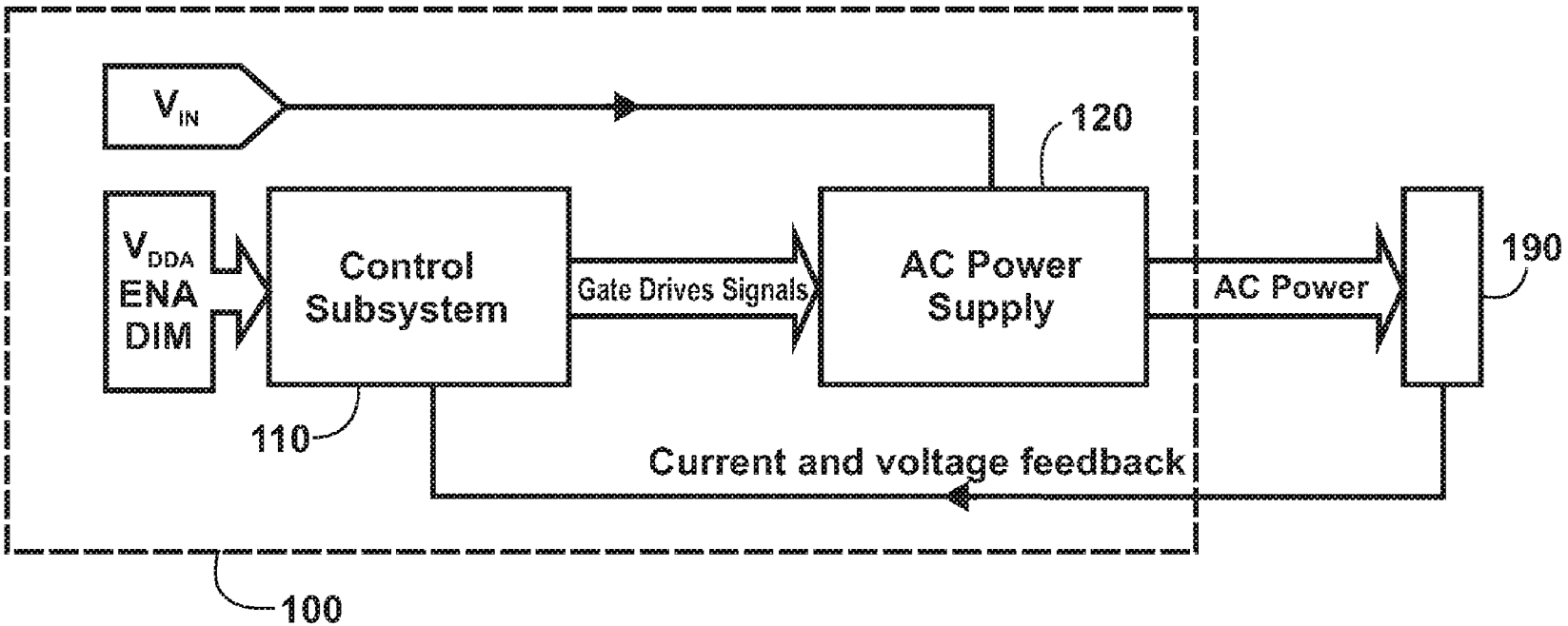
FIG. 1 is a simplified conventional driver system for CCFL and/or EEFL.
Figure 2:
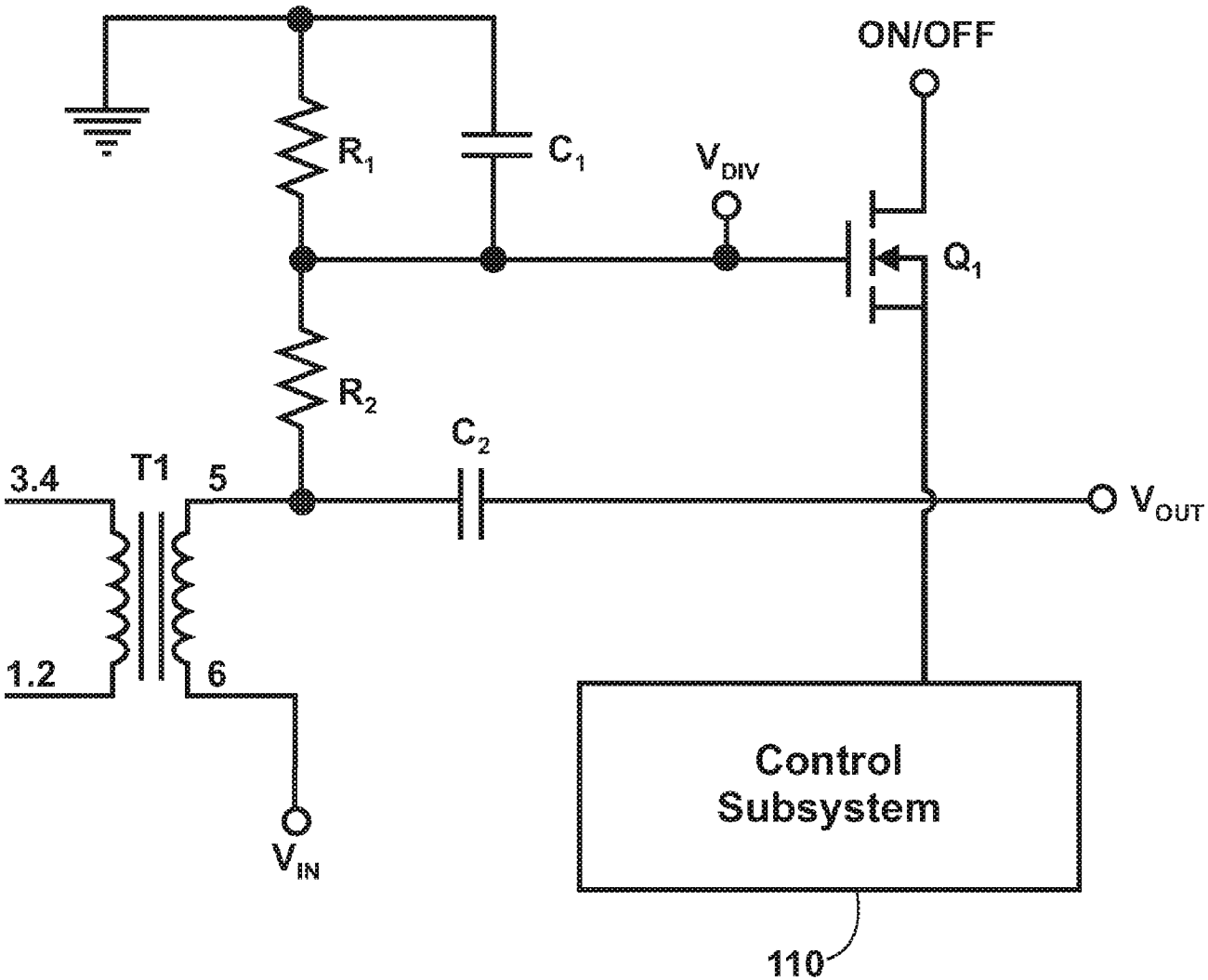
FIG. 2 is a simplified conventional system for detecting breakpoint in transformer secondary winding.
Figure 3:
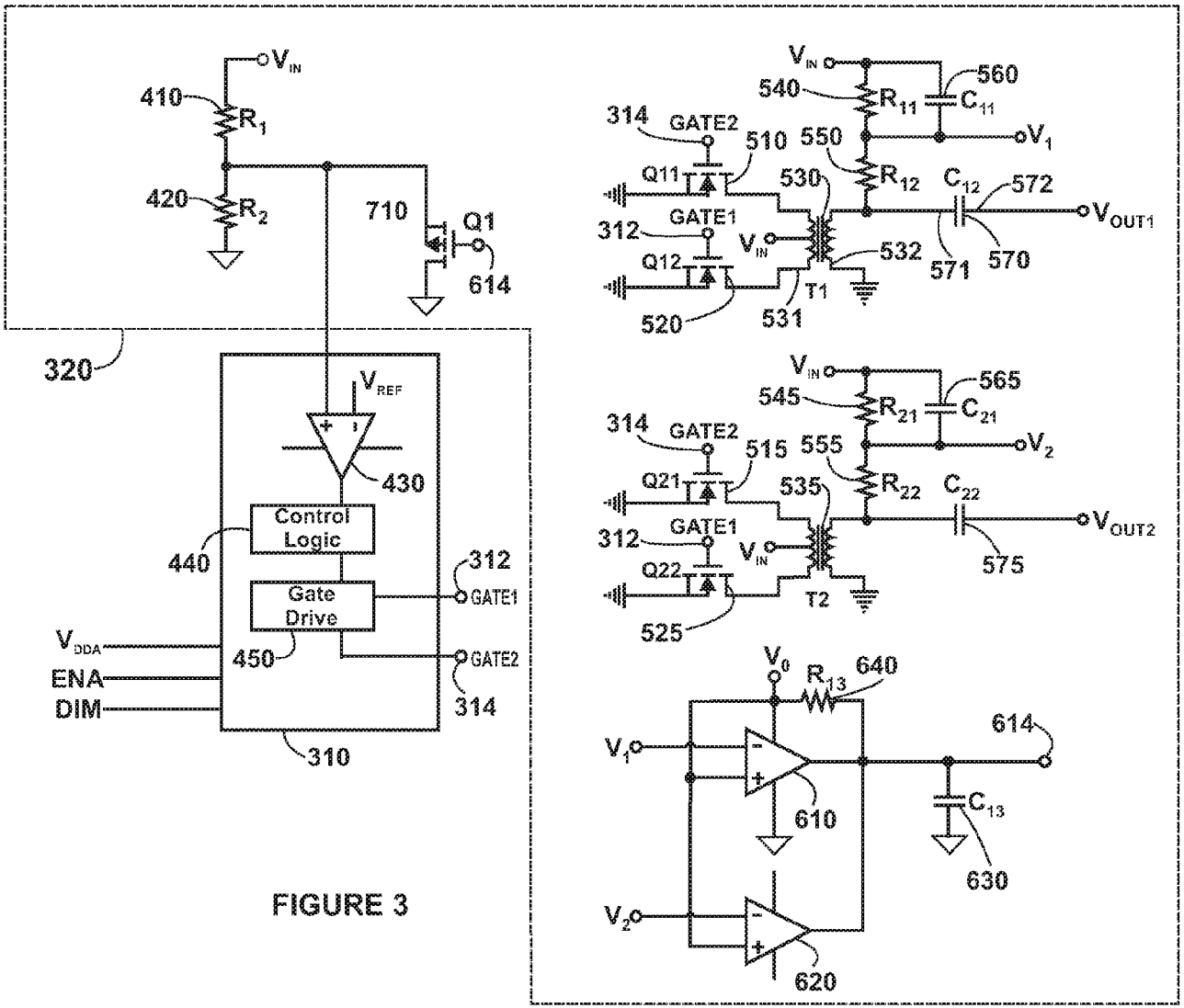
FIG. 3 is a simplified driver system according to an embodiment of the present invention.

FIG. 3 is a simplified driver system according to an embodiment of the present invention. This diagram is merely an example, which should not unduly limit the scope of the claims. One of ordinary skill in the art would recognize many variations, alternatives, and modifications. The driver system 300 includes a control subsystem 310 and an AC power supply subsystem 320. The control subsystem 310 includes a comparator 430, a control logic component 440, and a gate drive component 450. The AC power supply subsystem 320 includes resistors 410, 420, 540, 545, 550, 555 and 640, transistors 510, 515, 520, 525 and 710, transformers 530 and 535, capacitors 560, 565, 570, 575 and 630, and comparators 610 and 620. Although the above has been shown using a selected group of components for the system 300, there can be many alternatives, modifications, and variations. For example, some of the components may be expanded and/or combined. Other components may be inserted to those noted above. Depending upon the embodiment, the arrangement of components may be interchanged with others replaced. For example, the system 300 is used to regulate one or more cold-cathode fluorescent lamps and/or external-electrode fluorescent lamps. Further details of these components are found throughout the present specification and more particularly below.

The control subsystem 310 receives a power supply voltage $V_{DDA}$ and certain control signals. For example, the power supply voltage $V_{DDA}$ is equal to 5 volts. In another example, the control signals include an enabling (ENA) signal and a dimming (DIM) signal. The control subsystem 310 outputs gate drive signals 312 and 314 to the AC power supply subsystem 320. Additionally, the AC power supply subsystem 320 receives a DC voltage $V_{IN}$ and generates AC voltages $V_{OUT1}$ and $V_{OUT2}$. For example, the DC voltage $V_{IN}$ is equal to 12 volts. In another example, the peak-to-peak amplitude for each of the AC voltages $V_{OUT1}$ and $V_{OUT2}$ ranges from several hundred volts to several thousand volts. In yet another example, the AC voltages $V_{OUT1}$ and $V_{OUT2}$ are sent to drive cold-cathode fluorescent lamps and/or external-electrode fluorescent lamps.

Figure 4:
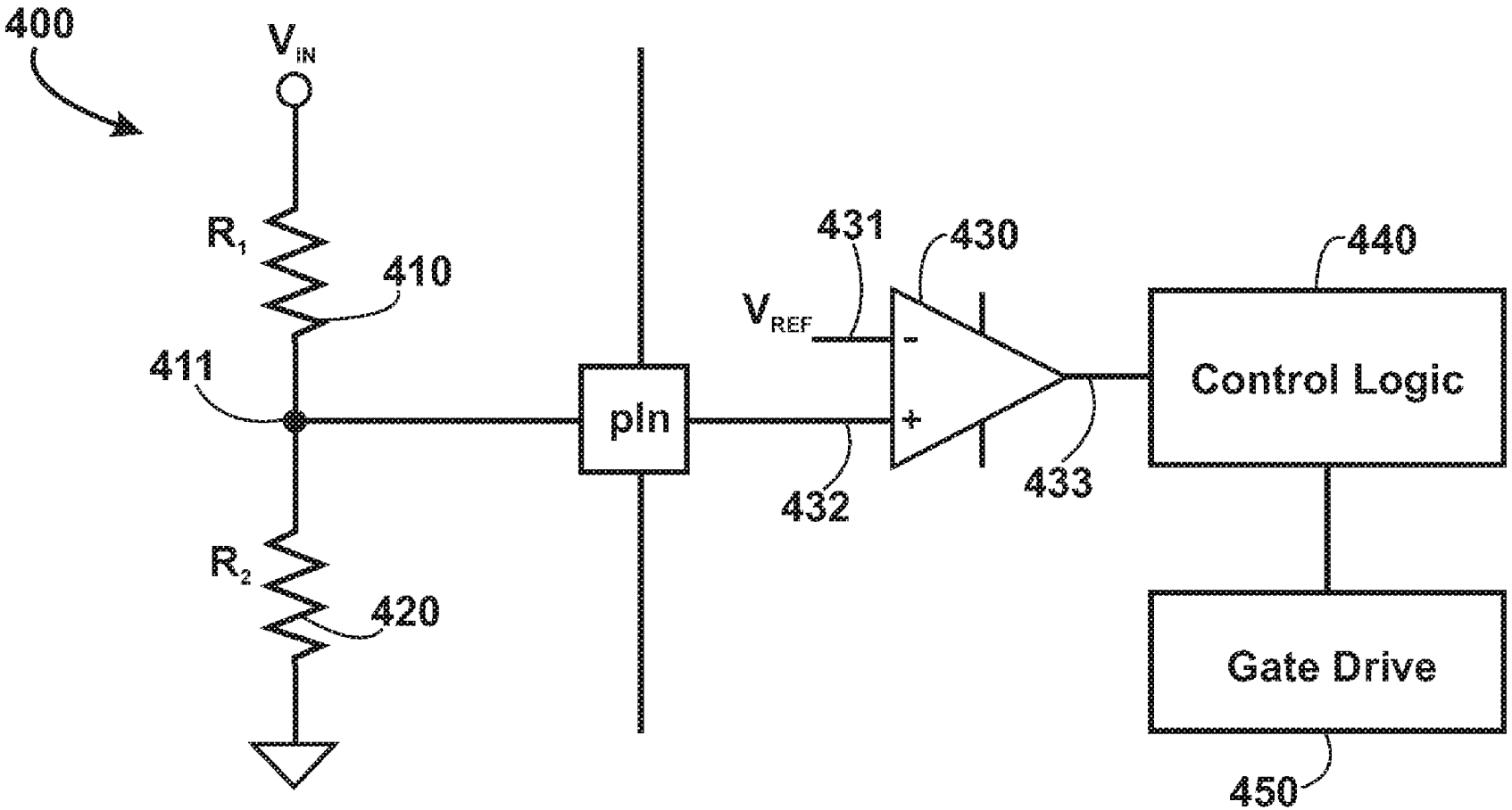
FIG. 4 is a simplified subsystem for protecting the driver system according to an embodiment of the present invention.

FIG. 4 is a simplified subsystem for protecting the driver system 300 according to an embodiment of the present invention. This diagram is merely an example, which should not unduly limit the scope of the claims. One of ordinary skill in the art would recognize many variations, alternatives, and modifications. The subsystem 400 includes the comparator 430, the control logic component 440, the gate drive component 450, and the resistors 410 and 420. Although the above has been shown using a selected group of components for the subsystem 400, there can be many alternatives, modifications, and variations. For example, some of the components may be expanded and/or combined. Other components may be inserted to those noted above. Depending upon the embodiment, the arrangement of components may be interchanged with others replaced. For example, the subsystem 400 is used to protect the driver system 300 for one or more cold-cathode fluorescent lamps and/or one or more external-electrode fluorescent lamps. Further details of these components are found throughout the present specification and more particularly below.

The comparator 430, the control logic component 440, and the gate drive component 450 are parts of the control subsystem 310. Additionally, the resistors 410 and 420 are parts of the AC power supply subsystem 320. The resistor 410 has resistance $R_1$, and the resistor 420 has resistance $R_2$. The resistors 410 and 420 are connected in series through a node 411 to form a voltage divider and coupled between the ground voltage and the DC voltage $V_{IN}$. The comparator 430 includes input terminals 431 and 432 and an output terminal 433. The input terminal 431 is biased to a predetermined reference voltage $V_{REF}$, and the input terminal 432 is biased to a detected voltage $V_{DET}$, which is the voltage potential at the node 411. The comparator 430 compares the reference voltage $V_{REF}$ and the detected voltage $V_{DET}$, and in response outputs a comparison signal to the control signal component 440. Based on at least the comparison signal, the control logic component 440 provides a control signal to the gate drive component 450, which in response can turn on or off the driver system 300.

In one embodiment, if the comparison signal indicates the detected voltage $V_{DET}$ is lower than the reference voltage $V_{REF}$, the control signal from the control logic component 440 instructs the gate drive component 450 to turn off the driver system 300. For example, $$V_{DET} = \frac{R_2}{R_1 + R_2} \times V_{IN} \quad \text{(Equation 1)}$$

$$\text{If } V_{DET} < V_{REF} \quad \text{(Equation 2)}$$

$$V_{IN} < \frac{R_1 + R_2}{R_2} \times V_{REF} \quad \text{(Equation 3)}$$

Hence the driver system 300 is turned off if $V_{IN}$ is lower than a threshold voltage that is equal to $$\frac{R_1 + R_2}{R_2} \times V_{REF}.$$

For example, $R_1$ equals 91 kΩ, $R_2$ equals 15 kΩ, and $V_{REF}$ equals 1.25 volts, so the threshold voltage is equal to about 8.8 volts. If $V_{IN}$ is lower than 8.8 volts, the driver system 300 is turned off.

Figure 5:
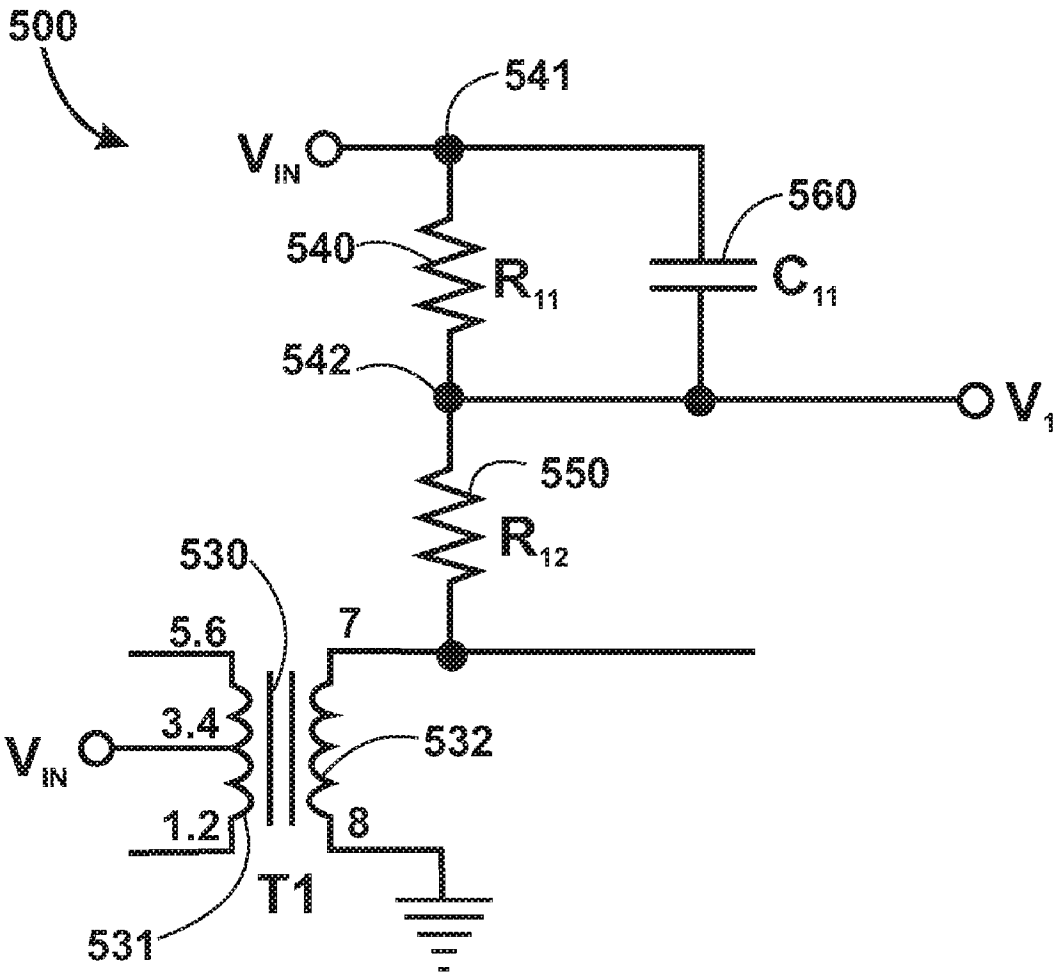
FIGS. 5, 6, and 7 are simplified diagrams showing a subsystem for protecting the driver system according to another embodiment of the present invention.
Figure 6:
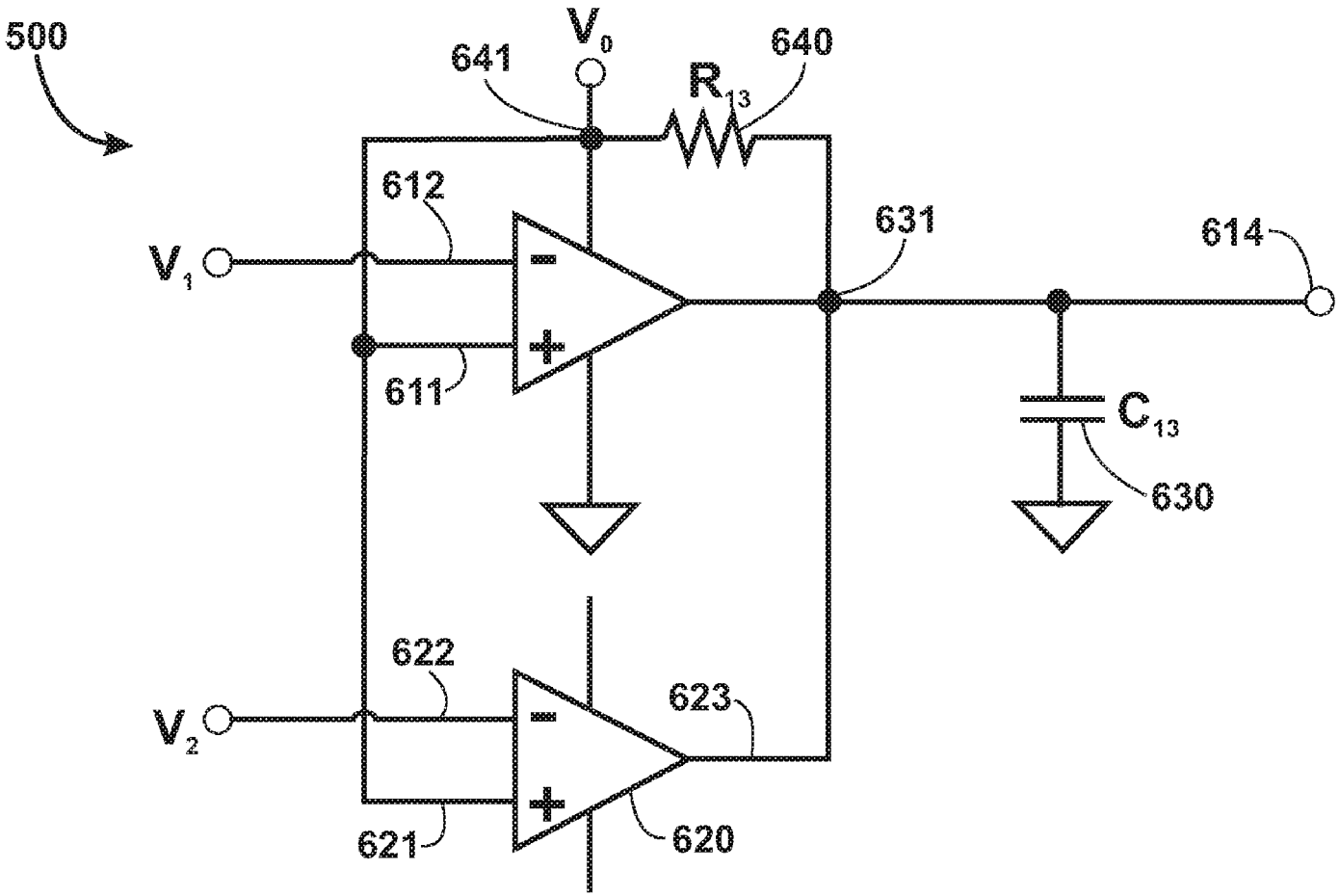
Figure 7:
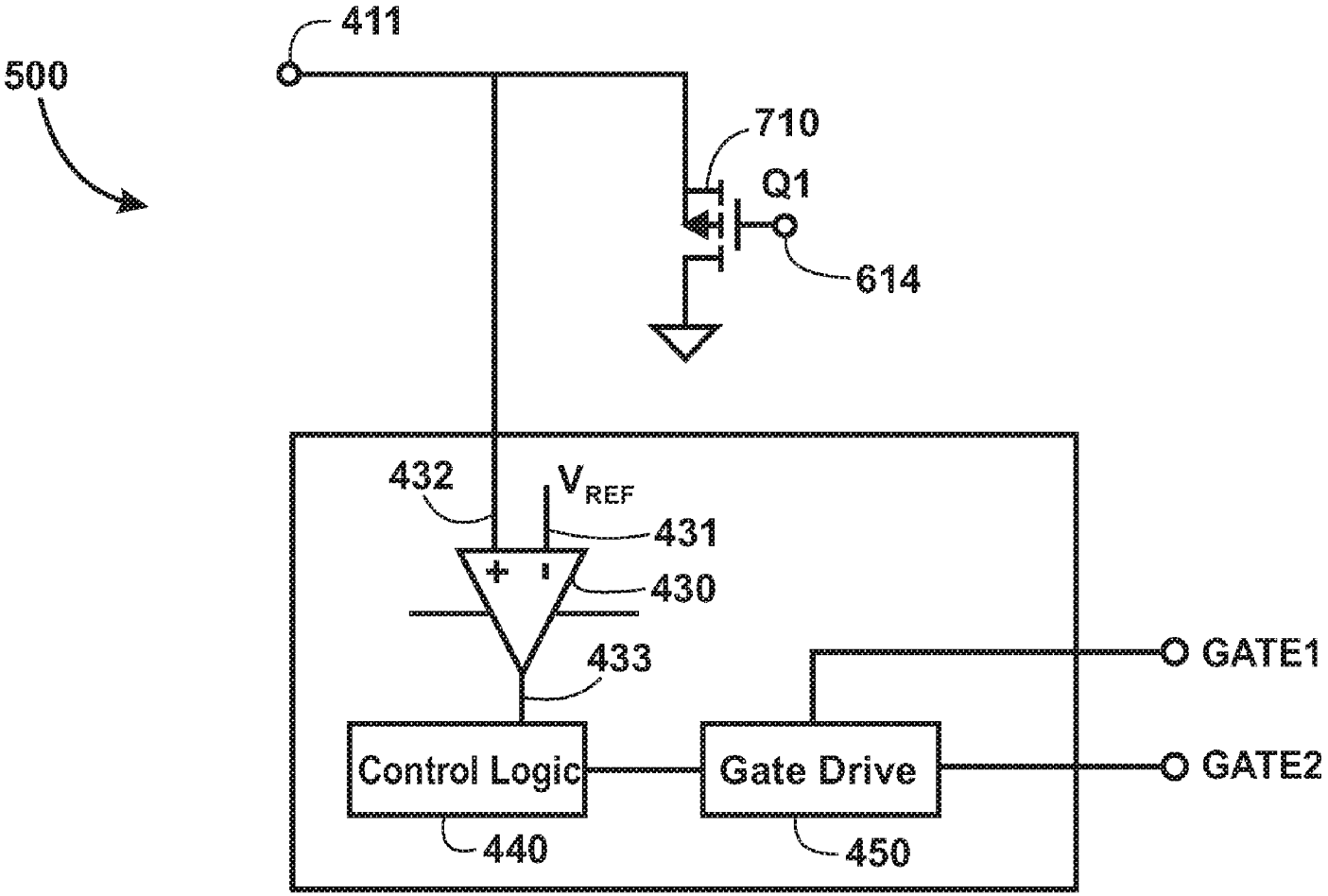

FIGS. 5, 6, and 7 are simplified diagrams showing a subsystem for protecting the driver system 300 according to another embodiment of the present invention. These diagrams are merely examples, which should not unduly limit the scope of the claims. One of ordinary skill in the art would recognize many variations, alternatives, and modifications. The subsystem 500 includes the comparators 430 and 610, the control logic component 440, the gate drive component 450, the resistors 540, 550 and 640, the transistors 510, 520 and 710, the transformer 530, and the capacitors 560 and 630. Although the above has been shown using a selected group of components for the subsystem 500, there can be many alternatives, modifications, and variations. For example, some of the components may be expanded and/or combined. Other components may be inserted to those noted above. Depending upon the embodiment, the arrangement of components may be interchanged with others replaced. For example, the subsystem 500 is used to protect the driver system 300 for one or more cold-cathode fluorescent lamps and/or one or more external-electrode fluorescent lamps. Further details of these components are found throughout the present specification and more particularly below.

The comparator 430, the control logic component 440, and the gate drive component 450 are parts of the control subsystem 310. Additionally, the comparator 610, the resistors 540, 550 and 640, the transistors 510, 520 and 710, the transformer 530, and the capacitors 560 and 630 are parts of the AC power supply subsystem 320. As shown in FIG. 5, the transformer 530 includes a primary winding 531 and a secondary winding 532. The secondary winding 532 has resistance $R_{secondary}$, the resistor 540 has resistance $R_{11}$, and the resistor 550 has resistance $R_{12}$. The resistors 540 and 550 and the secondary winding 532 are connected in series and coupled between the ground voltage and the DC voltage $V_{IN}$. Additionally, the resistor 540 and the capacitor 560 are in parallel between nodes 541 and 542. At the node 542, the voltage potential is equal to a detected voltage $V_1$.

In one embodiment, an AC voltage exists at pin 7 of the transformer 531. For example, the AC voltage has a frequency of 50 kHz. The AC voltage is filtered out by the resistors 540 and 550 and the capacitor 560. For example, the capacitor 560 provides low impedance to the AC voltage. In another example, the capacitor 560 has a capacitance value of 27 nF. Accordingly, the AC component can be ignored for the detected voltage $V_1$, and the detected voltage $V_1$ is determined as follows:

$$V_1 \approx \frac{R_{12} + R_{secondary}}{R_{11} + R_{12} + R_{secondary}} \times V_{IN} \quad \text{(Equation 4)}$$

As shown in FIG. 6, the comparator 610 includes input terminals 611 and 612 and an output terminal 613. The input terminal 611 is biased to a predetermined reference voltage $V_0$, and the input terminal 612 is biased to the detected voltage $V_1$. The comparator 610 compares the reference voltage $V_0$ and the detected voltage $V_1$, and in response generates a comparison signal at the output terminal 613. For example, the reference voltage $V_0$ is equal to 5 volts. In another example, the comparison signal is at the logic low level if the detected voltage $V_1$ is higher than the reference voltage $V_0$. In yet another example, the comparison signal 614 is at the logic high level if the detected voltage $V_1$ is lower than the reference voltage $V_0$.

In another embodiment, the subsystem 500 includes another comparator 620. The comparator 620 includes input terminals 621 and 622 and an output terminal 623. The input terminal 621 is biased to the predetermined reference voltage $V_0$, and the input terminal 622 is biased to another detected voltage $V_2$. The comparator 620 compares the reference voltage $V_0$ and the detected voltage $V_2$, and in response outputs a comparison signal at the output terminal 623. For example, the reference voltage $V_0$ is equal to 5 volts. In another example, the comparison signal is at the logic low level if the detected voltage $V_1$ is higher than the reference voltage $V_0$. In yet another example, the comparison signal is at the logic high level if the detected voltage $V_1$ is lower than the reference voltage $V_0$.

As shown in FIG. 6, the output terminals 613 and 623 are directly connected at a node 631. The node 631 is coupled to a node 641 through the resistor 640, and is coupled to the ground voltage level through the capacitor 630. For example, the resistor 640 has a resistance value of 10 kΩ. In another example, the capacitor 630 has a capacitance value of 100 pF. At the node 631, a signal 614 is outputted to the transistor 710. For example, the signal 614 is at the logic high level only if both the comparison signals at the output terminals 613 and 623 are at the logic high level. In another example, the signal 614 is at the logic low level if at least one of the comparison signals at the output terminals 613 and 623 is at the logic low level.

As shown in FIG. 7, the signal 614 is used to turn on or off the transistor 710. The transistor 701 serves as a switch. For example, the transistor 710 is closed or turned on if the signal 614 is at the logic low level. Hence, the input terminal 432 is biased to substantially the ground voltage level, which is lower than the reference voltage $V_{REF}$. In another example, the transistor 710 is open or turned off if the signal 614 is at the logic high level. Hence the input terminal 432 is biased to the voltage at the node 411 as discussed above for FIG. 4.

The comparator 430 compares the voltage level at the input terminal 432 and the reference voltage $V_{REF}$ at the input terminal 431, and in response outputs the comparison signal to the control signal component 440. Based on at least the comparison signal, the control logic component 440 provides a control signal to the gate drive component 450, which in response can turn on or off the driver system 300. In one embodiment, if the comparison signal indicates the voltage level at the input terminal 432 is lower than the reference voltage $V_{REF}$, the control signal from the control logic component 440 instructs the gate drive component 450 to turn off the driver system 300.

As discussed above, the detected voltage $V_1$ can be determined according to Equation 4. In one embodiment, $$\text{if } V_1 > V_0 \quad \text{(Equation 5)}$$

$$V_{IN} > \frac{R_{11} + R_{12} + R_{secondary}}{R_{12} + R_{secondary}} \times V_0 \quad \text{(Equation 6)}$$

Hence the comparison signal at the output terminal 613 is at the logic low level if $V_{IN}$ is larger than a threshold voltage that is equal to $$\frac{R_{11} + R_{12} + R_{secondary}}{R_{12} + R_{secondary}} \times V_0.$$

For example, $R_{11}$ equals 13 MΩ, $R_{12}$ equals 6.2 MΩ, $R_{secondary}$ equals 600Ω, and $V_0$ equals 5 volts, so the threshold voltage is equal to about 15.5 volts. If $V_{IN}$ is higher than 15.5 volts, the comparison signal at the output terminal 613 is at the logic low level. If the comparison signal at the output terminal 613 is at the logic low level, the signal 614 is also at the logic low level. Hence, the driver system 300 is turned off if $V_{IN}$ is larger than the threshold voltage.

In another embodiment, the secondary winding 532 includes one or more breakpoints, so $R_{secondary}$ of the secondary winding 532 becomes very large. Accordingly, the detected voltage $V_1$ is substantially equal to the DC voltage $V_{IN}$ as follows:

$$V_1 \approx \frac{R_{12} + R_{secondary}}{R_{11} + R_{12} + R_{secondary}} \times V_{IN} \approx V_{IN} \quad \text{(Equation 7)}$$

For example, the DC voltage $V_{IN}$ is higher than the reference voltage $V_0$. Accordingly, the detected voltage $V_1$ is also higher than the reference voltage $V_0$ based on Equation 7. In another example, the DC voltage $V_{IN}$ is equal to 12 volts, and the reference voltage $V_0$ is equal to 5 volts. Hence the comparison signal at the output terminal 613 is at the logic low level, and the signal 614 is also at the logic low level. Accordingly, the driver system 300 is turned off if the secondary winding 532 includes one or more breakpoints.

Returning to FIG. 3, the control subsystem 310 outputs the gate drive signals 312 and 314 to the AC power supply subsystem 320. The control subsystem 310 includes the gate drive component 450, and the AC power supply subsystem 320 includes the transistors 510 and 520. The gate drive signals 312 and 314 are generated by the gate drive component 450 and received by the transistors 520 and 510 respectively. The transistors 510 and 520 are coupled to the primary winding 531 of the transformer 530. Additionally, the secondary winding 532 of the transformer 530 is coupled to a terminal 571 of the capacitor 570. Another terminal 572 of the capacitor 570 provides the AC voltage $V_{OUT1}$. The gate drive signals 312 and 314 turns on or off the driver system 300 by controlling the AC voltage $V_{OUT1}$.

The driver system 300 includes the transformers 530 and 535. The transformer 530 is associated with the transistors 510 and 520, the resistors 540 and 550, the capacitors 560 and 570, and the comparator 610. The transformer 535 is associated with the transistors 515 and 525, the resistors 545 and 555, the capacitors 565 and 575, and the comparator 620. For example, the arrangement and operation principle for the transformer 535, the transistors 515 and 525, the resistors 545 and 555, the capacitors 565 and 575, and the comparator 620 are substantially the same as the arrangement and operation principle for the transformer 530, the transistors 510 and 520, the resistors 540 and 550, the capacitors 560 and 570, and the comparator 610. In another example, the transformer 530 is used to generate the AC voltage $V_{OUT1}$, and the transformer 535 is used to generate the AC voltage $V_{OUT2}$. The AC voltages $V_{OUT1}$ and $V_{OUT2}$ can be the same or different.

As discussed above and further emphasized here, FIGS. 3-7 are merely examples, which should not unduly limit the scope of the claims. One of ordinary skill in the art would recognize many variations, alternatives, and modifications. For example, one of the transformers 530 and 535 and certain associated components are removed. In another example, one or more additional transformers and some associated components are added to generate one or more additional AC voltages. As discussed above, the driver system 300 includes three protection mechanisms. Specifically, the driver system 300 is turned off if the DC voltage $V_{IN}$ is lower than a threshold voltage, if the DC voltage $V_{IN}$ is larger than a threshold voltage, or if the secondary winding of anyone of the transformers 530 and 535 includes one or more breakpoints. In one embodiment, the driver system 300 is modified so that one of these three protection mechanisms is removed. In another embodiment, the driver system 300 is modified so that two of these three protection mechanisms are removed.

According to another embodiment of the present invention, a system for driving a cold-cathode fluorescent lamp includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. If the DC input voltage is lower than a predetermined threshold, the system for driving the cold-cathode fluorescent lamp is turned off in response to the one or more control signals. For example, the system is implemented according to the system 300 including the subsystem 400.

According to another embodiment, a system for driving a cold-cathode fluorescent lamp includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. If the DC input voltage is higher than a predetermined threshold, the system for driving the cold-cathode fluorescent lamp is turned off in response to the one or more control signals. For example, the system is implemented according to the system 300 including the subsystem 500.

According to yet another embodiment, a system for driving a cold-cathode fluorescent lamp includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. The power supply subsystem includes a transformer including a primary winding and a secondary winding. If the DC input voltage is lower than a first predetermined threshold, the system for driving the cold-cathode fluorescent lamp is turned off in response to the one or more control signals. If the DC input voltage is higher than a second predetermined threshold, the system for driving the cold-cathode fluorescent lamp is turned off in response to the one or more control signals. If the secondary winding includes a breakpoint, the system for driving the cold-cathode fluorescent lamp is turned off in response to the one or more control signals. For example, the system is implemented according to the system 300 including the subsystem 400 and the subsystem 500.

According to yet another embodiment, a system for driving a cold-cathode fluorescent lamp includes a control subsystem configured to generate one or more control signals, and a power supply subsystem configured to receive the one or more control signals and a DC input voltage, convert the DC input voltage to an AC output voltage, and send the AC output voltage to a cold-cathode fluorescent lamp. The power supply subsystem includes a first resistor, a second resistor, a first capacitor, and a transformer including a primary winding and a secondary winding. The secondary winding, the first resistor, and the second resistor are in series. The second resistor is located between the first resistor and the secondary winding, and the secondary winding includes a first terminal biased to a ground voltage level. The first resistor includes a second terminal and a third terminal. The second terminal is biased to the DC input voltage, and the third terminal is coupled to the second resistor. The first resistor and the first capacitor are in parallel between the second terminal and the third terminal, and the third terminal is associated with a first detected voltage. The first detected voltage is compared to a first predetermined voltage for determining the one or more control signals. For example, the system is implemented according to the system 300 including the subsystem 500.

According to yet another embodiment, a method for driving a cold-cathode fluorescent lamp includes receiving a DC input voltage, determining whether the DC input voltage is lower than a first predetermined threshold or higher than a second predetermined threshold, and generating one or more control signals based on at least information associated with the DC input voltage, the first predetermined threshold, and the second predetermined threshold. Additionally, the method includes receiving the one or more control signals, converting the DC input voltage into an AC output voltage in response to the one or more control signals, and sending the AC output voltage to a cold-cathode fluorescent lamp. If the DC input voltage is lower than the first predetermined threshold, the AC output voltage is substantially equal to zero. If the DC input voltage is higher than the second predetermined threshold, the AC output voltage is substantially equal to zero. For example, the converting the DC input voltage into an AC output voltage is performed by at least a transformer. The transformer includes a primary winding and a secondary winding. Additionally, the method includes determining whether the secondary winding includes a breakpoint. If the secondary winding includes a breakpoint, the AC output voltage is substantially equal to zero. In another example, the method is performed by the system 300 including the subsystem 400 and the subsystem 500.

According to yet another embodiment, a system for driving an external-electrode fluorescent lamp includes a control subsystem configured to generate one or more control signals, and a power supply subsystem configured to receive the one or more control signals and a DC input voltage, convert the DC input voltage to an AC output voltage, and send the AC output voltage to an external-electrode fluorescent lamp. If the DC input voltage is lower than a predetermined threshold, the system for driving the external-electrode fluorescent lamp is turned off in response to the one or more control signals. For example, the system is implemented according to the system 300 including the subsystem 400.

According to yet another embodiment, a system for driving an external-electrode fluorescent lamp includes a control subsystem configured to generate one or more control signals, and a power supply subsystem configured to receive the one or more control signals and a DC input voltage, convert the DC input voltage to an AC output voltage, and send the AC output voltage to an external-electrode fluorescent lamp. If the DC input voltage is higher than a predetermined threshold, the system for driving the external-electrode fluorescent lamp is turned off in response to the one or more control signals. For example, the system is implemented according to the system 300 including the subsystem 500.

According to yet another embodiment, a system for driving an external-electrode fluorescent lamp includes a control subsystem configured to generate one or more control signals, and a power supply subsystem configured to receive the one or more control signals and a DC input voltage, convert the DC input voltage to an AC output voltage, and send the AC output voltage to an external-electrode fluorescent lamp. The power supply subsystem includes a transformer including a primary winding and a secondary winding. If the DC input voltage is lower than a first predetermined threshold, the system for driving the external-electrode fluorescent lamp is turned off in response to the one or more control signals. If the DC input voltage is higher than a second predetermined threshold, the system for driving the external-electrode fluorescent lamp is turned off in response to the one or more control signals. If the secondary winding includes a breakpoint, the system for driving the external-electrode fluorescent lamp is turned off in response to the one or more control signals. For example, the system is implemented according to the system 300 including the subsystem 400 and the subsystem 500.

According to yet another embodiment, a system for driving an external-electrode fluorescent lamp includes a control subsystem configured to generate one or more control signals, and a power supply subsystem configured to receive the one or more control signals and a DC input voltage, convert the DC input voltage to an AC output voltage, and send the AC output voltage to an external-electrode fluorescent lamp. The power supply subsystem includes a first resistor, a second resistor, a first capacitor, and a transformer including a primary winding and a secondary winding. The secondary winding, the first resistor, and the second resistor are in series. The second resistor is located between the first resistor and the secondary winding, and the secondary winding includes a first terminal biased to a ground voltage level. The first resistor includes a second terminal and a third terminal. The second terminal is biased to the DC input voltage, and the third terminal is coupled to the second resistor. The first resistor and the first capacitor are in parallel between the second terminal and the third terminal. The third terminal is associated with a first detected voltage, and the first detected voltage is compared to a first predetermined voltage for determining the one or more control signals. For example, the system is implemented according to the system 300 including the subsystem 500.

According to yet another embodiment, a method for driving an external-electrode fluorescent lamp includes receiving a DC input voltage, determining whether the DC input voltage is lower than a first predetermined threshold or higher than a second predetermined threshold, and generating one or more control signals based on at least information associated with the DC input voltage, the first predetermined threshold, and the second predetermined threshold. Additionally, the method includes receiving the one or more control signals, converting the DC input voltage into an AC output voltage in response to the one or more control signals, and sending the AC output voltage to an external-electrode fluorescent lamp. If the DC input voltage is lower than the first predetermined threshold, the AC output voltage is substantially equal to zero. If the DC input voltage is higher than the second predetermined threshold, the AC output voltage is substantially equal to zero. For example, the converting the DC input voltage into an AC output voltage is performed by at least a transformer. The transformer includes a primary winding and a secondary winding. Additionally, the method includes determining whether the secondary winding includes a breakpoint. If the secondary winding includes a breakpoint, the AC output voltage is substantially equal to zero. In another example, the method is performed by the system 300 including the subsystem 400 and the subsystem 500.

The present invention has various advantages. Some embodiments of the present invention provide a driver system with one or more protection mechanisms. For example, the driver system is protected against under-voltage system power supply, over-voltage system power supply, and/or breaking of transformer secondary winding. In another example, the driver system is used to drive one or more cold-cathode fluorescent lamps and/or one or more external-electrode fluorescent lamps. Certain embodiments of the present invention provide protection against breaking of a secondary winding. The breaking of the secondary winding can cause arcing, which may damage the secondary winding. Arcing often is difficult to detect during the testing process, so it is very important to protect the driver system when the breaking of the secondary winding occurs. Some embodiments of the present invention provide protection against under-voltage system power supply. Such protection is very important because a low DC input voltage can cause current stress to a power MOSFET transistor. Certain embodiments of the present invention provide protection against over-voltage system power supply. Such protection is very important because a high DC input voltage can cause voltage stress between the drain and source of a power MOSFET transistor.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system for driving a cold-cathode fluorescent lamp, the system comprising:

a control subsystem configured to generate one or more control signals; and a power supply subsystem configured to receive the one or more control signals and a DC input voltage, convert the DC input voltage to an AC output voltage, and send the AC output voltage to a cold-cathode fluorescent lamp;

wherein:

the power supply subsystem includes a first resistor, a second resistor, a first capacitor, and a transformer including a primary winding and a secondary winding;

the secondary winding includes a first terminal biased to a ground voltage level;

the first resistor includes a second terminal and a third terminal, the second terminal being biased to the DC input voltage, the third terminal being coupled to the second resistor;

the first resistor and the first capacitor are in parallel between the second terminal and the third terminal; and the third terminal is associated with a detected voltage, the detected voltage being compared to a first predetermined voltage for determining the one or more control signals.

2. The system of claim 1 wherein:

the system is configured to be turned off in response to the one or more control signals if the DC input voltage is higher than a predetermined threshold; and the predetermined threshold is proportional to the first predetermined voltage.

3. The system of claim 1 wherein:

the power supply subsystem further includes a second capacitor including a fourth terminal and a fifth terminal;

the fourth terminal is coupled to the second resistor and the secondary winding; and the fifth terminal is configured to provide the AC output voltage.

4. The system of claim 1 wherein:

the power supply subsystem further includes a first comparator configured to compare the detected voltage and the first predetermined voltage and generate a first comparison signal;

the first comparison signal is at a logic low level if the detected voltage is higher than the first predetermined voltage; and the first comparison signal is at a logic high level if the detected voltage is lower than the first predetermined voltage.

5. The system of claim 4 wherein:

the first comparison signal is used to generate a logic signal; and the logic signal is at the logic low level if the first comparison signal is at the logic low level.

6. The system of claim 5 wherein:

the control subsystem includes a second comparator and a gate drive device coupled to the second comparator, the second comparator including a fourth terminal and a fifth terminal, the fifth terminal being biased to a second predetermined voltage;

the power supply subsystem further includes a switch configured to receive the logic signal and including a sixth terminal and a seventh terminal, the sixth terminal being coupled to the fourth terminal, the seventh terminal being biased to the ground voltage level;

the second comparator is configured to compare a received voltage at the sixth terminal and the second predetermined voltage and generate a second comparison signal; and the gate drive device is configured to generate the one or more control signals in response to the second comparison signal.

7. The system of claim 6 wherein:

the switch is configured to be closed if the logic signal is at the logic low level; and the switch is further configured to be open if the logic signal is at the logic high level.

8. The system of claim 6 wherein the switch includes a transistor.

9. The system of claim 6 wherein the control subsystem further comprises a control logic device, the gate drive device being coupled to the second comparator through the control logic device.

10. The system of claim 9 wherein the one or more control signals include one or more gate drive signals.

11. The system of claim 6 wherein the power supply subsystem further includes a third resistor and a fourth resistor, the third resistor including an eighth terminal and a ninth terminal, the fourth resistor including a tenth terminal and an eleventh terminal, the eighth terminal being biased to the DC input voltage, the eleventh terminal being biased to the ground voltage level, the ninth terminal and the tenth terminal both being coupled to the fourth terminal.

12. The system of claim 11 wherein:

the system is configured to be turned off in response to the one or more control signals, if the DC input voltage is lower than a predetermined threshold; and the predetermined threshold is proportional to the second predetermined voltage.

13. A system for driving an external-electrode fluorescent lamp, the system comprising:

a control subsystem configured to generate one or more control signals; and a power supply subsystem configured to receive the one or more control signals and a DC input voltage, convert the DC input voltage to an AC output voltage, and send the AC output voltage to an external-electrode fluorescent lamp;

wherein:

the power supply subsystem includes a first resistor, a second resistor, a first capacitor, and a transformer including a primary winding and a secondary winding;

the secondary winding includes a first terminal biased to a ground voltage level;

the first resistor includes a second terminal and a third terminal, the second terminal being biased to the DC input voltage, the third terminal being coupled to the second resistor;

the first resistor and the first capacitor are in parallel between the second terminal and the third terminal; and the third terminal is associated with a detected voltage, the detected voltage being compared to a first predetermined voltage for determining the one or more control signals.

14. The system of claim 13 wherein:

the system is configured to be turned off in response to the one or more control signals if the DC input voltage is higher than a predetermined threshold; and the predetermined threshold is proportional to the first predetermined voltage.

15. The system of claim 13 wherein:

the power supply subsystem further includes a second capacitor including a fourth terminal and a fifth terminal;

the fourth terminal is coupled to the second resistor and the secondary winding; and the fifth terminal is configured to provide the AC output voltage.

16. The system of claim 13 wherein:

the power supply subsystem further includes a first comparator configured to compare the detected voltage and the first predetermined voltage and generate a first comparison signal;

the first comparison signal is at a logic low level if the detected voltage is higher than the first predetermined voltage; and the first comparison signal is at a logic high level if the detected voltage is lower than the first predetermined voltage.

17. The system of claim 16 wherein:

the first comparison signal is used to generate a logic signal; and the logic signal is at the logic low level if the first comparison signal is at the logic low level.

18. The system of claim 17 wherein:

the control subsystem includes a second comparator and a gate drive device coupled to the second comparator, the second comparator including a fourth terminal and a fifth terminal, the fifth terminal being biased to a second predetermined voltage;

the power supply subsystem further includes a switch configured to receive the logic signal and including a sixth terminal and a seventh terminal, the sixth terminal being coupled to the fourth terminal, the seventh terminal being biased to the ground voltage level;

the second comparator is configured to compare a received voltage at the sixth terminal and the second predetermined voltage and generate a second comparison signal; and the gate drive device is configured to generate the one or more control signals in response to the second comparison signal.

19. The system of claim 18 wherein:

the switch is configured to be closed if the logic signal is at the logic low level; and the switch is further configured to be open if the logic signal is at the logic high level.

20. The system of claim 18 wherein the switch includes a transistor.

21. The system of claim 18 wherein the control subsystem further comprises a control logic device, the gate drive device being coupled to the second comparator through the control logic device.

22. The system of claim 21 wherein the one or more control signals include one or more gate drive signals.

23. The system of claim 18 wherein the power supply subsystem further includes a third resistor and a fourth resistor, the third resistor including an eighth terminal and a ninth terminal, the fourth resistor including a tenth terminal and an eleventh terminal, the eighth terminal being biased to the DC input voltage, the eleventh terminal being biased to the ground voltage level, the ninth terminal and the tenth terminal both being coupled to the fourth terminal.

24. The system of claim 23 wherein:

the system is configured to be turned off in response to the one or more control signals, if the DC input voltage is lower than a predetermined threshold; and the predetermined threshold is proportional to the second predetermined voltage.

* * * * *